US009523049B2

(12) United States Patent
Verstraete et al.

(10) Patent No.: US 9,523,049 B2
(45) Date of Patent: Dec. 20, 2016

(54) HYDROCRACKING PROCESS INCLUDING SWITCHABLE REACTORS WITH FEEDSTOCKS CONTAINING 200 PPM BY WEIGHT—2% BY WEIGHT OF ASPHALTENES

(75) Inventors: Jan Jeroum Verstraete, Lyons (FR); Hugues Dulot, Lyons (FR); Fabrice Bertoncini, Lyons (FR); Eric Sanchez, Saint Genis Laval (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 1920 days.

(21) Appl. No.: 12/640,202

(22) Filed: Dec. 17, 2009

(65) Prior Publication Data

US 2010/0155293 A1 Jun. 24, 2010

(30) Foreign Application Priority Data

Dec. 18, 2008 (FR) ..... 08 07270

(51) Int. Cl.

| | |
|---|---|
| ***C10G 65/12*** | (2006.01) |
| ***C10G 45/08*** | (2006.01) |
| ***C10G 47/12*** | (2006.01) |

(52) U.S. Cl.

CPC ..... *C10G 65/12* (2013.01); *C10G 45/08* (2013.01); *C10G 47/12* (2013.01)

(58) Field of Classification Search

CPC ..... C10G 45/08; C10G 47/12; C10G 65/12
See application file for complete search history.

(56) References Cited

U.S. PATENT DOCUMENTS

| | | | | |
|---|---|---|---|---|
| 4,741,821 | A | 5/1988 | Hung et al. | |
| 5,320,741 | A | 6/1994 | Johnson et al. | |
| 6,156,695 | A * | 12/2000 | Soled et al. | 502/305 |
| 6,162,350 | A * | 12/2000 | Soled et al. | 208/113 |
| 6,306,287 | B1 | 10/2001 | Billon et al. | |
| 7,288,182 | B1 * | 10/2007 | Soled et al. | 208/112 |
| 7,935,244 | B2 | 5/2011 | Roy-Auberger et al. | |

(Continued)

FOREIGN PATENT DOCUMENTS

| | | |
|---|---|---|
| CA | 2 079 196 | 3/1993 |
| EP | 0 450 997 | 10/1991 |

(Continued)

OTHER PUBLICATIONS

Callejas, et al., Hydroprocessing of a Maya Residue, Instrinsic Kinetics of Sulfur-, Nitrogen-, Nickel- and Vanadium-Removal Reactions, 1999, Energy & Fuels, 13, pp. 629-636.*

(Continued)

*Primary Examiner* — In Suk Bullock
*Assistant Examiner* — Derek Mueller
(74) *Attorney, Agent, or Firm* — Millen White Zelano & Branigan, P.C.

(57) ABSTRACT

The invention relates to a process for hydrocracking hydrocarbon feedstocks having 200 ppm by weight to 2% by weight of asphaltenes and/or more than 10 ppm by weight of metals, comprising a hydrodemetallation treatment in at least 2 switchable reaction zones, containing hydrodemetallation catalyst and optionally hydrodenitrification catalyst, then a hydrorefining treatment to lower the organic nitrogen content, followed by a fixed-bed hydrocracking treatment and a distillation step.

23 Claims, 1 Drawing Sheet

(56) References Cited

U.S. PATENT DOCUMENTS

| | | | | |
|---|---|---|---|---|
| 2004/0055934 | A1 | 3/2004 | Tromeur et al. | |
| 2005/0211603 | A1* | 9/2005 | Guillaume et al. | 208/111.3 |
| 2006/0060503 | A1* | 3/2006 | Soled et al. | 208/111.3 |
| 2006/0060510 | A1 | 3/2006 | Bhan et al. | |
| 2007/0090024 | A1* | 4/2007 | Soled et al. | 208/209 |
| 2007/0175797 | A1 | 8/2007 | Iki et al. | |
| 2008/0223755 | A1 | 9/2008 | Roy-Auberger et al. | |

FOREIGN PATENT DOCUMENTS

| | | |
|---|---|---|
| EP | 0 565 205 | 10/1993 |
| EP | 1 600 491 | 11/2005 |
| EP | 1 775 019 | 4/2007 |
| FR | 2 681 871 | 4/1993 |
| FR | 2 764 211 | 12/1998 |
| FR | 2 784 687 | 4/2000 |
| FR | 2 913 691 | 9/2008 |
| WO | WO-02 48288 | 6/2002 |

OTHER PUBLICATIONS

Furimsky, Selection of Catalysts and Reactors for Hydroprocessing, 1998, Applied Catalysis A: General 171, pp. 177-206.*

Rana et al., "A review of recent advances on process technologies for upgrading of heavy oils and residua," Fuel, IPC Science and Technology Press, Jan. 26, 2007, vol. 86. No. 9, pp. 1261-1231.

Search Report for FR-0 807 269 dated Nov. 4, 2009.

Inst Francais Du Petrole, "Process for hydrotreament of petroleum residue or heavy oil for refining and conversion to lighter fractions," Espacenet, Publication Date: Oct. 9, 1991; English Abstract of EP-0 450 997.

Elf Antar France, "Procede de preparation de catalyseurs d'hydrotraitement," Espacenet, Publication Date: Dec. 11, 1998; English Abstract of FR-2 764 211.

International Search Report for FR-0 807 270 dated Jun. 3, 2009.

* cited by examiner

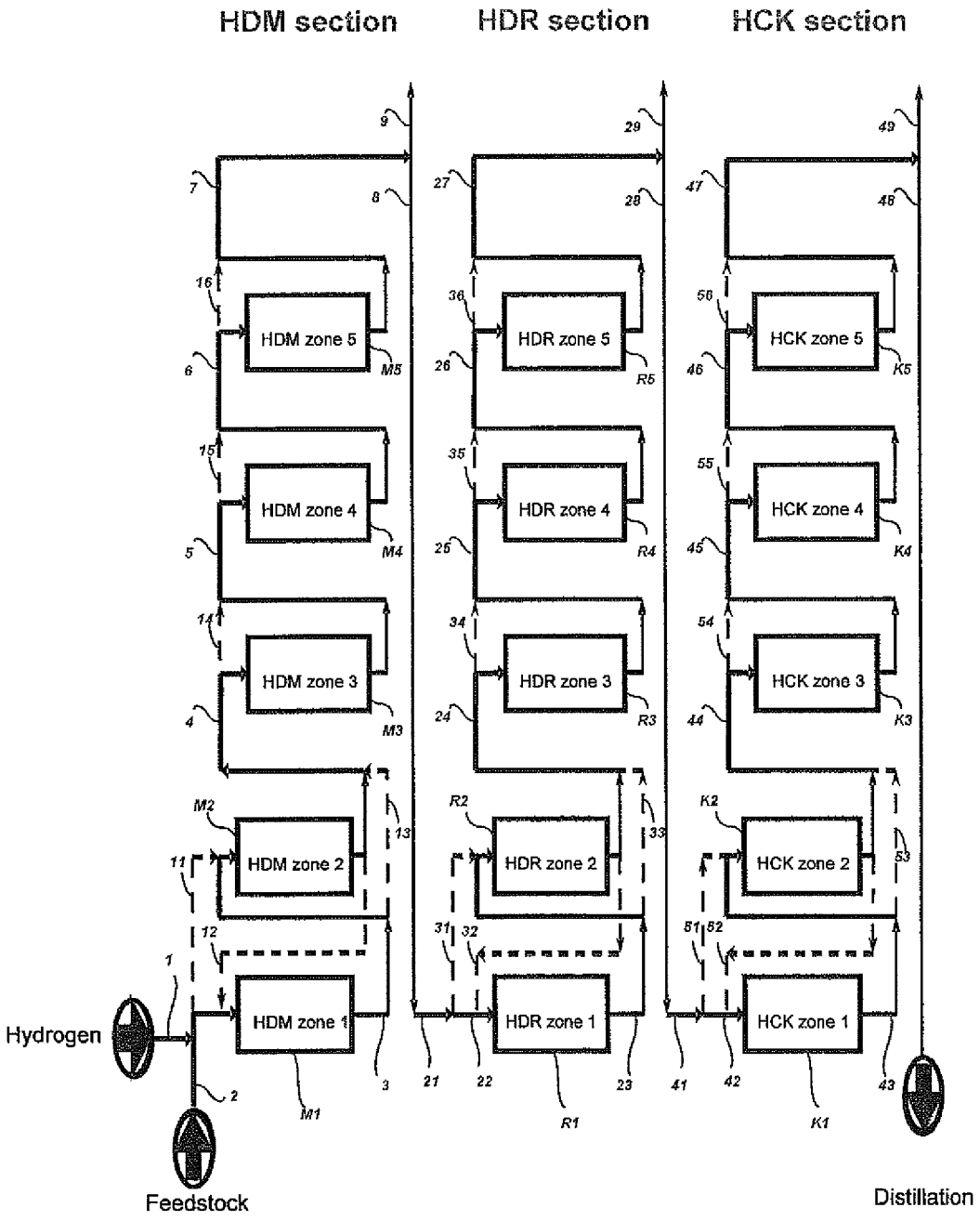
HDM section
HDR section
HCK section
HDM zone 5
HDM zone 4
HDM zone 3
HDM zone 2
HDM zone 1
HDR zone 5
HDR zone 4
HDR zone 3
HDR zone 2
HDR zone 1
HCK zone 5
HCK zone 4
HCK zone 3
HCK zone 2
HCK zone 1
Hydrogen
Feedstock
Distillation

HYDROCRACKING PROCESS INCLUDING SWITCHABLE REACTORS WITH FEEDSTOCKS CONTAINING 200 PPM BY WEIGHT—2% BY WEIGHT OF ASPHALTENES

CROSS REFERENCE TO RELATED APPLICATION

This application may be related to Assignees co-pending application PET-2574 entitled "Hydrodemetallization And Hydrodesulphurization Catalysts, And Use In A Single Formulation In A Concatenated Process" incorporated by reference herein.

The present invention relates to the refining and the conversion of feedstocks which are heavy hydrocarbon fractions containing inter alia sulphur-containing, nitrogen-containing and metallic impurities. Advantageously, these are vacuum distillates and deasphalted oils, as the sole or mixed feedstock. Liquid feedstocks contain asphaltenes in a proportion of at least 200 ppm by weight and at most 2% by weight, and/or more than 10 ppm by weight of metals (generally nickel and vanadium).

Patent FR 2 840 621 describes a process for the hydrocracking of typical feedstocks containing at least 20% by volume and often at least 80% by volume of compounds boiling above 340° C. Preferably, these typical feedstocks have a boiling point T5 of higher than 340° C., and better still higher than 370° C., i.e. 95% of the compounds present in the feedstock have a boiling point of higher than 340° C., and better still higher than 370° C. The nitrogen content of the hydrocarbon feedstocks treated in the conventional process is commonly higher than 500 ppm by weight. Generally, the sulphur content is between 0.01 and 5% by weight and the metals content is lower than 5 ppm by weight. The asphaltenes content is lower than 200 ppm by weight. The feedstock purity constraints are imposed by the stability of the catalytic beds used in order to be able to adhere to an economically advantageous run duration of about 3 years.

The treated feedstocks are, for example, vacuum distillates, deasphalted oils, feedstocks originating from aromatics extraction units, oil bases, etc.

Feedstocks of this type are therefore currently treated in fixed-bed processes. In these fixed-bed processes, the feedstock passes through a plurality of catalytic beds arranged in series, in one or more reactors, the first catalytic bed or beds functioning as a guard bed and being used to carry out therein above all the hydrodemetallation (HDM) of the feedstock as well as a part of the hydrorefining, the following catalytic bed or beds being used to carry out the deep hydrorefining (HDR) of the feedstock, and in particular hydrodenitrification (HDN) and hydrodesulphurisation (HDS), before hydrocracking the feedstock in the last catalytic bed or beds. The effluents drawn off after the last catalytic bed are then fractionated to produce various petroleum cuts.

The advocated process therefore consists in using upstream of the hydrocracking section (using a zeolitic, amorphous or mixed catalyst) a section for hydrorefining over low-acidity amorphous catalyst.

Despite using the best catalytic systems, the possibility has been noted of greatly reducing the operating duration when using feedstocks containing more than 200 ppm by weight of asphaltenes and/or more than 10 ppm by weight of metals. Indeed, the catalysts rapidly become loaded with metals and are therefore deactivated. This leads to a decrease in the demetallation and deasphaltenation performance levels, resulting in an accelerated deactivation of the hydrorefining and hydrocracking catalysts. In order to compensate for this deactivation, the temperatures can be increased, but this promotes the formation of coke and the increase in the losses of feedstock. This means that the hydrocracking unit has to be stopped at least every 6 to 10 months in order to replace the deactivated or clogged catalytic beds; this operation can last more than one month, thus reducing the operating factor of the unit accordingly.

Generally, the treatment of feedstocks having an asphaltenes content of higher than 200 ppm by weight, like heavy deasphalted oils and vacuum distillates originating from thermal and/or hydroconversion processes such as the processes for the hydroconversion of residues in a fixed bed (Hyvahl for example), in an ebullated bed (H-Oil for example) or in slurry mode (HDH+ for example), necessitates a consistent pretreatment.

According to the prior art, a feedstock treatment of this type would lead to independent and/or cumulative modification of the hourly volume rate (HVR) or, generally, of the operating conditions of the process such as the temperature and the hydrogen partial pressure level. These modifications of the operating conditions and/or the design of the process would have a major impact on outlay and the operating cost in order to adhere to the same run duration of the industrial process.

The present invention proposes to dispense with such a change of operating conditions while at the same time adhering to a run duration of the hydrocracking process that is equivalent to the typical feedstock treatment for hydrocracking.

In patent EP 1,343,857, which relates to the treatment of varied feedstocks ranging from distillates to residues, the metals contents are from 1 to 1,500 ppm by weight in general and the asphaltenes contents can exceed 2% by weight in the case of residues. The treatment consists in a hydrodemetallation (HDM) followed by a hydrodesulphurisation (HDS), the HDM zone(s) being preceded by at least two HDM-type and regenerable, catalyst-loaded guard zones. After in-situ regeneration of the catalyst of a guard zone, the guard zone is reconnected in the same manner as initially (mode called "simple" in the present document) or in a different order (mode called "exchanged" in the present document).

The present invention allows the direct treatment of feedstocks containing contents very much higher than the conventional specifications; these feedstocks may be treated alone or in a mixture, while at the same time preserving a conventional run duration.

The feedstocks which can be treated in accordance with the invention usually contain at least 200 ppm by weight and at most 2% by weight of asphaltenes, and/or more than 10 ppm by weight of metals (nickel and vanadium).

The objective of the catalytic hydrocracking of these feedstocks is both to refine, i.e. to substantially reduce their content of metals, sulphur, nitrogen and other impurities, while at the same time improving the hydrogen-to-carbon (H/C) ratio and while at the same time transforming them more or less partially into lighter cuts, wherein the various effluents thus obtained can serve as bases for the production of high-quality petrol, gas oil and fuel oil, or as feedstocks for other refining units, such as the catalytic cracking of vacuum distillates or the catalytic cracking of residues.

The problem posed by the catalytic hydrocracking of these feedstocks having a high asphaltenes content is complex: on the one hand, the nitrogen-containing compounds contained in these feedstocks greatly inhibit the catalytic activity of the actual hydrocracking catalysts, generally zeolitic, amorphous or mixed catalysts; on the other hand, the asphaltenes and metals contained in these feedstocks are gradually deposited on the catalyst in the form of coke and metals sulphides, and rapidly deactivate and clog the catalytic system; this means that the system has to be stopped for replacement thereof. Moreover, these products inhibit the hydrodenitrification (HDN) reaction.

The processes for catalytic hydrocracking of this type of feedstocks therefore have to be designed so as to allow an operating run that is as long as possible without stopping the unit, the objective being to achieve an operating run of 3 years.

It has been found that the process of the invention allows the run duration to be lengthened considerably with high hydrorefining and hydrocracking performance levels while at the same time preserving the stability of the products.

The process of the present invention operates with a fixed-bed hydrocracking catalyst. The heavy hydrocarbon feedstock containing at least 200 ppm by weight and at most 2% by weight of asphaltenes and/or more than 10 ppm by weight of metals (generally nickel and vanadium) is treated in a hydrodemetallation section, then in a deep hydrorefining section, followed by an actual hydrocracking section.

More specifically, the invention relates to a process for hydrocracking of hydrocarbon feedstocks containing 200 ppm to 2% by weight of asphaltenes, and/or more than 10 ppm by weight of metals, wherein said feedstock is subjected to a hydrodemetallation treatment at 300° C. and 450° C., under a total pressure of from 50 to 300 bar, and with a hydrogen/hydrocarbons ratio of between 200 $Nm^3/m^3$ and 2,000 $Nm^3/m^3$, said treatment being carried out in at least 2 switchable reaction zones each containing at least one hydrodemetallation catalyst and optionally containing a hydrodenitrification catalyst, then at least a part of the effluent, which is at least partly demetallated and optionally partly denitrified, is hydrorefined in a hydrorefining section containing at least one hydrotreatment catalyst in order to lower the organic nitrogen content to below 20 ppm by weight, the hydrorefining being carried out at a temperature of 300° C. and 450° C., under a total pressure of from 50 to 300 bar, with a hydrogen/hydrocarbons ratio of between 200 $Nm^3/m^3$ and 2,000 $Nm^3/m^3$, then at least a part of the effluent, which is at least partly denitrified, is hydrocracked in a hydrocracking section containing at least one fixed-bed hydrocracking catalyst, at 300° C. and 450° C., under a total pressure of from 50 to 300 bar, and a hydrogen/hydrocarbons ratio of between 300 $Nm^3/m^3$ and 3,000 $Nm^3/m^3$, then at least a part of the hydrocracked effluent is distilled by atmospheric distillation in order to obtain at least one gas oil cut, a naphtha cut and an atmospheric residue, said residue optionally being at least partly distilled under vacuum in order to obtain at least one vacuum distillate and a vacuum residue.

Use is advantageously made of specific catalysts adapted to each type of reaction (in each section), under the operating conditions appropriate for each type of reaction.

The Feedstocks

The feedstocks entering the HDM section that can be treated in accordance with the invention usually contain at least 200 ppm by weight (often at least 300 ppm, or even at least 500 ppm, or else at least 1,000 ppm) and at most 2% by weight of asphaltenes (often at most 1% by weight), and/or more than 10 ppm by weight of metals (generally more than 10 ppm by weight of Ni+V).

These are hydrocarbon fractions containing inter alia sulphur-containing, nitrogen-containing, oxygen-containing and metallic (most often nickel and vanadium) impurities. The process of the invention is particularly well suited to deasphalted oils and vacuum distillates, taken alone or in a mixture, but other feedstocks corresponding to the foregoing asphaltenes and metals criteria are also suitable. These other feedstocks may for example be mixtures of feedstocks. Thus, the feedstock (most often a vacuum distillate (VGO) and/or a deasphalted oil (DAO)) can be mixed with the effluents obtained from conversion units.

More particularly, these external feedstocks (originating from other units such as, for example, a thermal cracking unit, a catalytic cracking unit, a coking unit and/or a coal liquefaction unit) can be added to a fresh feedstock and treated in the process according to the invention provided that the mixture corresponds to the foregoing asphaltenes and/or metals criteria.

The Hydrodemetallation (HDM) Section

The hydrodemetallation section receives the feedstock to be treated as defined hereinbefore in terms of its asphaltenes and metals content.

In order to carry out the hydrodemetallation, the ideal hydrodemetallation catalyst must be capable of treating the asphaltenes of the feedstock, while at the same time having a high demetallating power associated with a high metals retention capacity and a high resistance to coking. The catalysts which are usually used contain group VIII and VIB metals deposited on an amorphous support, most often alumina, and have a macropore volume which is more or less high depending on the degree of impurities (asphaltenes, metals, etc.) of the feedstock to be treated. The applicant has developed catalysts of this type on particular macroporous supports such as those described, for example, in patents EP-B-98764, EP-B-113297 and EP-B-113284, which give the applicant precisely the qualities which are sought in order to carry out these transformations:

Demetallation rates of from at least 10% up to 95%;

Macropore volume (pores having a diameter of >25 nm) of higher than 5% of the total pore volume;

Metals retention capacity which is generally higher than 10% relative to the weight of the new catalyst, allowing longer operating runs to be obtained;

High resistance to coking even at temperatures higher than 390° C.; this helps to lengthen the duration of the runs which are often limited by the increase in the loss of feedstock and the loss of activity due to the production of coke.

Effective catalysts for the HDM section can be bought from the suppliers known to the person skilled in the art such as, inter alia and as a function of the characteristics of the feedstock, the catalysts HMC841, HMC845, HMC945, HMC868, HF858, HM848 sold by the company AXENS, for example.

In a particularly advantageous manner, the hydrodemetallation section comprises a sequence of 2 or more HDM catalysts, the average diameter of which decreases in the direction of flow of the feedstock. In other words, the catalyst having the highest average diameter receives the feedstock, and the feedstock passes through catalysts having an increasingly low average diameter.

Advantageously, the various catalysts of the HDM section also have different activities, by modifying the matrix (by varying inter alia the support used, the porosity, the specific surface area, etc.) and/or the catalytic formulation (by varying inter alia the active metals, the active metals contents, the types of dopants, the dopants contents, etc.).

Advantageously, the HDM section operates with a sequence of 2 or more hydrodemetallation catalysts, the activity of which increases in the direction of flow of the feedstock. In other words, the least active catalyst receives the feedstock, and the feedstock passes through the increasingly active catalysts.

Advantageously, in order to improve the denitrification, each of the switchable reaction zones of the hydrodemetallation section contains hydrodemetallation catalyst and hydrodenitrification catalyst.

Very advantageously, the invention proposes using for the HDM and HDR reaction zones a particular catalytic system (called "grading" in the present document) which will be described in greater detail in conjunction with the deep hydrorefining section.

The HDM section can be divided into a plurality of reaction zones. The term "reaction zones" refers to one or more reactors or one or more catalytic beds situated in a single reactor. The term "switchable reaction zones" refers to at least two switchable reactors. In the text, non-switchable by-passable zones will be called "by-passable reaction zones".

In the process of the invention, the HDM section comprises at least 2 switchable reaction zones, optionally followed by one or more finishing HDM reaction zones.

Advantageously, the HDM section is composed of at least 2 switchable reaction zones containing at least one catalyst bed carrying out both the hydrodemetallation and a part of the hydrodenitrification.

According to the invention, the feedstock is treated in at least 2 hydrodemetallation switchable reaction zones each containing at least one hydrodemetallation catalyst, and optionally containing a denitrification catalyst, and arranged in series in order to be used in a cyclic manner consisting in successively repeating steps b) and c) defined hereinafter:

a) a step in which the reaction zones are used all together for a duration at most equal to the time for deactivating and/or clogging one of them,
b) a step during which at least one of the switchable reaction zones is by-passed and the catalyst which it contains is regenerated and/or replaced by fresh or regenerated catalyst,
c) a step during which the reaction zones are used all together, the reaction zones, the catalyst of which has been regenerated and/or replaced over the course of the preceding step, being reconnected either in their initial positions (what is known as the "simple" mode) or in another position among the switchable reaction zones (what is known as the "exchanged" mode), and said step being conducted over a duration at most equal to the time for deactivating and/or clogging one of the reaction zones.

Preferably, the HDM section functions with reaction zones in exchanged mode, in which the reaction zone, the catalyst of which has been replaced or regenerated, is reconnected so as to be in the last position (in the direction of flow of the feedstock) in the series of the switchable reaction zones of the HDM section. This advantageous provision allows the operating factor of the unit and the run duration of the process to be improved.

According to another embodiment, the HDM section comprises at least 2 reaction zones in parallel, one part of which is operative while the other part is undergoing catalyst regeneration or replacement; the process operating normally only over a part of the reaction zones.

According to an advantageous provision, optionally combined with the preceding provisions, each of the switchable reaction zones and/or the finishing HDM reaction zones also contain at least one hydrodenitrification catalyst. The hydrodenitrification catalyst may be identical or different to that of the deep hydrorefining section. The hydrodenitrification catalysts are described hereinafter in the deep hydrorefining section.

The operating conditions for carrying out HDM are generally temperatures of between 300° C. and 450° C., preferably between 360° C. and 420° C., total pressures of from 50 to 300 bar, preferably between 80 and 180 bar, and hydrogen-to-hydrocarbons ratios of between 200 $Nm^3/m^3$ and 2,000 $Nm^3/m^3$, preferably between 500 and 1,500 $Nm^3/m^3$. The conditions for operation of the various HDM reaction zones may be different from one another.

The Hydrorefining (HDR) Section

At least a part (and generally all) of the effluent obtained from the HDM section is sent to the HDR section. Generally, it is sent immediately, without separating the gas phase, but a separation, for example a flash separation, is quite conceivable.

The HDR section comprises at least one reaction zone containing at least one hydrorefining catalyst having preferably a high activity for hydrodenitrification.

In the same way as for the HDM section, it is possible to provide a plurality of reaction zones. One or more of the reaction zones can then be disconnected in order to replace or regenerate the catalyst(s) that they contain and be reconnected in simple mode or in exchanged mode using the procedure described hereinbefore.

In order to promote hydrorefining (mainly HDS and HDN), the catalysts must have a high hydrogenating power in order to deeply refine the products: denitrification, desulphurisation, and optionally conducting demetallation and lowering the asphaltenes content. The hydrorefining catalysts can be selected from the catalysts commonly used in this field. The hydrorefining catalyst can, preferably, comprise a matrix, at least one hydro-dehydrogenating element selected from the group formed by the elements of group VIB and group VIII of the periodic table.

The matrix can consist of compounds, used alone or in a mixture, such as alumina, halogenated alumina, silica, silica-alumina, clays (selected for example from natural clays such as kaolin or bentonite), magnesia, titanium oxide, boron oxide, zirconia, aluminium phosphates, titanium phosphates, zirconium phosphates, coal, aluminates. Use is preferably made of matrices containing alumina, in all these forms known to the person skilled in the art, and even more preferably aluminas, for example gamma alumina.

The hydro-dehydrogenating element can be selected from the group formed by the elements of group VIB and non-noble group VIII of the periodic table. Preferably, the hydro-dehydrogenating element is selected from the group formed by molybdenum, tungsten, nickel and cobalt. More preferably, the hydro-dehydrogenating element comprises at least one group VIB element and at least one non-noble group VIII element. This hydro-dehydrogenating element can, for example, comprise a combination of at least one group VIII element (Ni, Co) with at least one group VIB element (Mo, W).

Preferably, the hydrorefining catalyst further comprises at least one doping element deposited on said catalyst and selected from the group formed by phosphorus, boron and silicon. In particular, the hydrorefining catalyst can comprise, as doping elements, boron and/or silicon, with optionally phosphorus too. The boron, silicon, phosphorus contents are generally between 0.1 and 20% by weight, preferably 0.1 and 15% by weight, more preferably between 0.1 and 10% by weight.

The hydrorefining catalyst can advantageously comprise phosphorus. This compound provides inter alia two main advantages to the hydrorefining catalyst, a first advantage being the fact that it is easier to prepare said catalyst, in particular during the impregnation of the hydro-dehydrogenating element, for example from nickel and molybdenum-based solutions. A second advantage afforded by this compound is an increase in the hydrogenation activity of the catalyst.

The hydrorefining catalyst can further comprise at least one group VIIA element (chlorine, fluorine preferred) and/or at least one group VIIB element (manganese preferred), optionally at least one group VB element (niobium preferred).

In a preferred hydrorefining catalyst, the total concentration of group VIB and VIII metal oxides is between 2% (preferably 5%) and 40% by weight, preferably between 3% (preferably 7%) and 30% by weight, and the weight ratio expressed in metal oxide between group VIB metal (or metals) and group VIII metal (or metals) is between 20 and 1.25, preferably between 10 and 2. The phosphorus oxide $P_2O_5$ concentration can be lower than 15% by weight, preferably lower than 10% by weight. Preferred supports are alumina or silica-alumina containing 5-95% of $SiO_2$, taken alone or mixed with a zeolite.

In another hydrorefining catalyst comprising boron and/or silicon, preferably boron and silicon, said catalyst generally comprises, in % by weight relative to the total mass of said catalyst,

- from 1 to 99%, preferably 10 to 98% and more preferably 15 to 95% of at least one matrix,
- from 3 to 60%, preferably 3 to 45% and more preferably 3 to 30% of at least one group VIB metal,
- optionally from 0 to 30%, preferably 0 to 25% and more preferably 0 to 20% of at least one group VIII metal,
- from 0.1 to 20%, preferably 0.1 to 15% and more preferably
- 0.1 to 10% of boron and/or from 0.1 to 20%, preferably 0.1 to 15% and more preferably 0.1 to 10% of silicon,
- optionally from 0 to 20%, preferably 0.1 to 15% and more preferably 0.1 to 10% of phosphorus, and
- optionally from 0 to 20%, preferably 0.1 to 15% and more preferably 0.1 to 10% of at least one element selected from group VIIA, for example fluorine.

In another hydrorefining catalyst, said catalyst comprises:

- between 1 and 95% by weight (oxide %) of at least one matrix, preferably alumina,
- between 5 and 40% by weight (oxide %) of at least one group VIB and non-noble group VIII element,
- between 0 and 20%, preferably between 0.1 and 20% by weight (oxide %) of at least one promoter element selected from phosphorus, boron, silicon,
- between 0 and 20% by weight (oxide %) of at least one group VIIB element (manganese for example),
- between 0 and 20% by weight (oxide %) of at least one group VIIA element (fluorine, chlorine for example), and
- between 0 and 60% by weight (oxide %) of at least one group VB element (niobium for example).

Generally, preference is given to hydrorefining catalysts having the following atomic ratios:

- a group VIII metals/group VIB metals atomic ratio ranging from 0 to 1,
- when B is present, a B/group VIB metals atomic ratio ranging from 0.01 to 3,
- when Si is present, a Si/group VIB metals atomic ratio ranging from 0.01 to 1.5,
- when P is present, a P/group VIB metals atomic ratio ranging from 0.01 to 1, and
- a group VIIA elements/group VIB metals atomic ratio ranging from 0.01 to 2.

Particularly preferred hydrorefining catalysts are NiMo and/or NiW catalysts over alumina, also NiMo and/or NiW catalysts over alumina doped with at least one element from the group of the atoms formed by phosphorus, boron, silicon and fluorine.

The hydrorefining catalysts described hereinbefore are therefore used during the hydrorefining step, often called the hydrotreatment step.

The applicant has also developed catalysts of this type. Examples include the patents such as those described in patents FR2904243, FR2903979, EP1892038.

Effective catalysts of this type for the HDR section can be bought from suppliers known to the person skilled in the art such as, inter alia and as a function of the characteristics of the feedstock, the catalysts from the HR 300 (HR348, HR360 for example), HR 400 (HR448, HR468 for example) and HR 500 (HR526, HR538, HR548, HR558, HR 562, HR568 and HRK558 for example) series sold by the company AXENS. The type of catalyst is chosen by the person skilled in the art depending on the nature of the support and of the catalytic formulation, the general terms of which have been described hereinbefore.

In a particularly advantageous manner, the various catalysts of the HDR section also have different activities, by modifying the matrix (by varying inter alia the support used, the porosity, the specific surface area, etc.) and/or the catalytic formulation (by varying inter alia the active metals, the active metals contents, the types of dopants, the dopants contents, etc.). Indeed, the HDR section operates with a sequence of 2 or more hydrorefining catalysts, the activity of which increases in the direction of flow of the feedstock. In other words, the least active catalyst receives the feedstock, and the feedstock passes through the increasingly active catalysts.

Advantageously, the HDR section operates with a sequence of 2 or more hydrorefining catalysts, the average diameter of which decreases in the direction of flow of the feedstock. In other words, the catalyst having the highest average diameter receives the feedstock, and the feedstock passes through catalysts having an increasingly low average diameter.

The drawback of the catalysts having high hydrogenating power is that they are rapidly deactivated in the presence of metals or coke. Indeed, apart from its lower retention of metals, the hydrodenitrification performance decreases rapidly as metals are deposited. This is why the association of one or more appropriate catalysts carrying out HDM, capable of operating at a relatively high temperature in order to carry out most of the deasphaltenation and the demetallation, with one or more appropriate catalysts carrying out HDR, allows the HDR to be operated at relatively low temperatures, because the HDR catalysts are protected from the metals and the other impurities by the HDM section; thus, deep hydrogenation is carried out and coking is limited.

Association of the HDM and HDR Zones in a Particular Catalytic System

Preferably, the HDM and HDR zones operate with a particular catalytic system (called "grading" in the present document) which comprises at least two catalysts, one for hydrodemetallation and the other for hydrorefining, said catalysts comprise at least one support consisting of a porous refractory oxide, at least one group VIB metal, and at least two group VIII metals, of which one is the majority promoter called VIII-1 and the other or others are called co-promoter VIII-1 wherein i is between 2 and 5 and, in these catalysts, the group VIII elements are present in the proportions defined by the atomic ratio [VIII-1(VIII-1+ . . . +VIII-i)] of between 0.5 and 0.85 and at least one hydrodemetallation catalyst and at least one hydrorefining catalyst have an identical atomic ratio;

the hydrodemetallation catalyst(s) has/have a group VIB metal or metals content of between 2 and 9% by weight of trioxide of the group VIB metal or metals relative to the total mass of the catalyst, and the sum of the group VIII metals contents is between 0.3 and 2% by weight of the oxide of the group VIII metals relative to the total mass of the catalyst, the hydrorefining catalyst(s) has/have a group VIB metal or metals content which is strictly higher than 9 and lower than 17% by weight of trioxide of the group VIB metal or metals relative to the total mass of the catalyst, and the sum of the group VIII metals contents is strictly higher than 2 and lower than 5% by weight of the oxide of the group VIII metals relative to the total mass of the catalyst.

Advantageously, said catalytic system comprises HDM catalysts having a macropore volume (pores having a diameter of >25 nm) of higher than 5% of the total pore volume (TPV). Advantageously, said catalytic system comprises HDR catalysts having a macropore volume of lower than 10% of the total pore volume (TPV).

In an advantageous embodiment, said catalytic system is used on the first switchable input reaction zone(s) of the HDM section and on the first input reaction zone(s) of the HDR section. Most often, it is used on the 2 switchable reaction zones of the HDM section (which preferably does not comprise any other zones).

The HDR section generally comprises a by-passable reaction zone or zones which are downstream of the reaction zones containing said catalytic system and which preferably contain a catalyst or catalysts having metals contents higher than those of said catalytic system; these catalysts are those listed hereinbefore in the description of the HDR catalysts. This advantageous provision allows the hydrodenitrification to be induced and the performance of the catalyst thus to be improved.

Preferably, the HDR reaction zones are by-passable zones.

Operating Conditions

The operating conditions for carrying out HDR are generally temperatures of between 300° C. and 450° C., preferably between 360° C. and 420° C., total pressures of from 50 to 300 bar, preferably between 80 and 180 bar, and hydrogen-to-hydrocarbons ratios of between 200 $Nm^3/m^3$ and 2,000 $Nm^3/m^3$, preferably between 600 and 1,600 $Nm^3/m^3$. The conditions for operation of the various HDR reaction zones may be different from one another.

The Hydrocracking (HCK) Section

At least a part (and generally all) of the effluent obtained from the HDR section is sent to the HCK section. Generally, it is sent immediately, without separating the gas phase, but a separation, for example a flash separation, is quite conceivable.

The organic nitrogen content of the effluent entering on the hydrocracking catalyst in the HCK section must be kept below 20 ppm by weight, advantageously below 15 ppm by weight and preferably below 10 ppm by weight. The asphaltenes content is often lower than 200 ppm by weight or, better, than 50 ppm by weight.

The HCK section comprises at least one reaction zone containing at least one hydrocracking catalyst. In the same way as for the preceding sections, it is possible to provide a plurality of reaction zones. One or more of the reaction zones can then be disconnected in order to replace or regenerate the catalyst(s) that they contain and be reconnected in simple mode or in exchanged mode using the same procedure.

The hydrocracking catalysts must be bifunctional catalysts having a hydrogenating phase in order to be able to hydrogenate the aromatics and to achieve the balance between the saturated compounds and the corresponding olefins and an acid phase allowing the hydroisomerisation and hydrocracking reactions to be promoted. The acid function is provided by supports having large surface areas (generally 100 to 800 $m^2.g^{-1}$) having a surface acidity, such as halogenated (in particular chlorinated or fluorinated) aluminas, combinations of boron and aluminium oxides, amorphous silica-aluminas and zeolites. The hydrogenating function is provided either by one or more metals of group VIII of the periodic table of the elements, such as iron, cobalt, nickel, ruthenium, rhodium, palladium, osmium, iridium and platinum, or by an association of at least one metal of group VIB of the periodic table, such as molybdenum and tungsten, and at least one group VIII metal. The applicant has also developed a range of catalysts of this type. Examples include patents FR 2 819 430, FR 2 846 574, FR 2 875 417, FR 2 863 913, FR 2 795 341 and FR 2 795 342.

Effective catalysts for the HCK section can be bought from the suppliers known to the person skilled in the art such as, inter alia and as a function of the characteristics of the feedstock and the desired performance levels, the catalysts HTK758, HDK776, HDK766, HYK732, HYK752, HYK762, HYK742, HYC652, HYC642 sold by the company AXENS, for example.

The operating conditions for carrying out HCK are generally temperatures of between 300° C. and 450° C., preferably between 360° C. and 420° C., total pressures of from 50 to 300 bar, preferably between 80 and 180 bar, and hydrogen-to-hydrocarbons ratios of between 300 $Nm^3/m^3$ and 3,000 $Nm^3/m^3$, preferably between 600 and 1,600 $Nm^3/m^3$, and even more preferably between 1,000 and 2,000 $Nm^3/m^3$. The conditions for operation of the various HDR reaction zones may be different from one another.

The Distillation of the Hydrocracked Effluent

The product obtained from the HCK section is sent to a distillation zone comprising at least one flash tank and an atmospheric distillation, and optionally a vacuum distillation. At least one atmospheric distillate and an atmospheric residue are recovered from the atmospheric distillation.

A part of the atmospheric distillate or distillates can be advantageously recycled at the input of at least one of the reaction zones of the process (HDM and/or HDR and/or HCK), preferably at the input of the first reaction zone in operation for said section(s), for example the first reaction zone in operation of the HDM section.

A part of the atmospheric residue can also be recycled in the same way.

Of the atmospheric distillates, a gas oil fraction, a petrol fraction and a gas fraction are recovered most often in the atmospheric distillation zone. A part of this gas oil fraction can optionally be recycled in the same way as previously. All of the petrol fraction is then recovered.

Advantageously, the hydrocracking section can also be configured in accordance with a two-step hydrocracking scheme. In this case, the atmospheric residue leaving the atmospheric distillation zone is sent to a reaction zone containing at least one hydrocracking catalyst, which treats a feedstock containing preferably only this atmospheric residue, commonly called the non-converted fraction. The effluent of this reaction zone is then returned to the process according to the invention, preferably directly at the input of the distillation zone. In other words, the feedstock is demetallated, then hydrorefined and hydrocracked in a reaction zone K and the effluent is at least partly distilled in atmospheric distillation, a process in which the atmospheric residue obtained is at least partly hydrocracked in a reaction zone K, which is different from the reaction zone K, containing at least one hydrocracking catalyst, and the effluent obtained is at least partly distilled in the distillation zone.

Optionally, at least a part and preferably all of the atmospheric residue obtained from the atmospheric distillation zone is sent to a vacuum distillation zone from which at least one vacuum distillate and a vacuum residue, which is commonly called heavy oil in the field of hydrocracking, are recovered. Advantageously, a part of one of the vacuum distillates is recycled in the same way as previously.

The vacuum residue, commonly called heavy oil, can be sent at least in part to the storage zone of the refinery or to a dewaxing unit (either solvent dewaxing or catalytic dewaxing), or to a catalytic cracking unit (alone or preferably in a mixture), or to a steam cracking unit.

At least a part of the vacuum residue can also be recycled at the input of at least one of the reaction zones of the process (HDM and/or HDR and/or HCK, and preferably HDR and/or HCK), preferably at the input of the first reaction zone in operation for said section(s).

Thus, in one of the possible embodiments, at least a part of the gas oil cut and/or the vacuum distillate and/or the atmospheric residue is recycled to the hydrodemetallation section and/or to the hydrocracking section and/or to the hydrorefining section, generally at the input of at least one of the reaction zones of the process (HDM and/or HDR and/or HCK), preferably at the input of the first reaction zone in operation for said section(s).

In the configurations working with recycling, the amount of atmospheric distillate and/or vacuum distillate that is sent at the input of one of the reaction zones of the process represents, by weight, relative to the feedstock, about 1 to 60%, preferably 5 to 25% and more preferably about 10 to 20%. This recycling allows the yield to be increased significantly and the service life of the catalysts to be lengthened by way of their diluting effect on asphaltenes, metals and nitrogen.

Linking with Other Processes

Deasphalted Oils as the Feedstock

The process of the invention is particularly appropriate for treating deasphalted oils. According to a particular embodiment, an atmospheric residue and/or a vacuum residue, either of a crude oil or originating from another unit, is subjected to deasphalting with the aid of a solvent, for example a hydrocarbon solvent or a mixture of solvents. The deasphalted product is then advantageously at least in part injected at the input of one of the reaction zones of the process according to the present invention, generally at the input of the first reaction zone in operation.

The hydrocarbon solvent used most frequently is a paraffinic, olefinic or cyclanic hydrocarbon (or a mixture of hydrocarbons) having 3 to 7 carbon atoms. This treatment is generally carried out under conditions yielding a deasphalted product generally containing less than 1% by weight of heptane-precipitated asphaltenes in accordance with standard AFNOR NF T 60115, preferably less than 1,000 ppm by weight of asphaltenes. This deasphalting can be carried out by following the procedure described in patent U.S. Pat. No. 4,715,946 in the name of the applicant. The solvent/feedstock ratio by volume will most often be from about 3:1 to about 7:1 and the basic physicochemical operations which make up the overall deasphalting operation (mixing—precipitation, decanting of the asphaltene phase, washing—precipitation of the asphaltene phase) will most often be carried out separately.

The deasphalting can also comprise two stages, each stage including the three basic phases of precipitation, decanting and washing. In this specific case, the recommended temperature in each phase of the first stage is preferably on average lower by about 10° C. to about 40° C. than the temperature of each corresponding phase of the second stage.

The solvents used may also be of the phenol, glycol or C1 to C6 alcohols type. However, paraffinic and/or olefinic solvents having 3 to 6 carbon atoms will very advantageously be used.

According to a variant of the process, at least a part of what is known as an SR (straight run) gas oil fraction obtained from initial fractionation of the crude product, is also sent at the input of one of the reaction zones of the process. In this case, the gas oil cut that is treated is most often a cut, the initial boiling point of which is generally between about 140° C. and 260° C. and having a final boiling point of generally between about 340° C. and about 440° C. As these gas oil cuts contain neither asphaltenes nor metals, they allow the heaviest and the most contaminated feedstocks to be diluted, thus significantly increasing the yield and lengthening the service life of the catalysts by way of their diluting effect, in particular on asphaltenes, metals and nitrogen. The amounts of SR gas oil then sent to the process according to the invention are included in the total amount described hereinbefore.

Injection of External Feedstock

It is also possible to inject, at the input of at least one of the catalytic beds of the process, preferably at the input of the first zone in operation, at least one gas oil having an initial boiling point of between 140° C. and 260° C. and a final boiling point of between 300° C. and 440° C. or a heavy cycle oil HCO having an initial boiling point of between 300° C. and 450° C. and a final boiling point of between 400° C. and 600° C.

This may be a gas oil obtained from a hydrodesulphurisation unit or a gas oil obtained from an atmospheric residue and/or vacuum residue hydroconversion unit, operating for example in accordance with the HYVAHL process (conversion of heavy feedstocks in a fixed bed) or the H-Oil process (conversion of heavy feedstocks in an ebullated bed), or else a light cycle oil fraction obtained from a catalytic cracking unit, most often referred to by the person skilled in the art as an LCO for short, or else a gas oil fraction obtained from a heat treatment unit, such as the visbreaking unit or the coking unit, or else a gas oil fraction obtained from another unit. These various gas oils are petroleum cuts having an initial boiling point of generally between about 140° C. and about 260° C. and a final boiling point of generally between about 300° C. and about 440° C.

It is also possible to inject a heavy cycle oil fraction obtained from catalytic cracking and most often referred to by the person skilled in the art as an HCO for short, having an initial boiling point of generally between about 300° C. and about 450° C. and a final boiling point of generally between about 400° C. and about 600° C.

Catalytic Cracking

According to a variant of the process, at least a part of the atmospheric residue and/or the vacuum distillate and/or the vacuum residue obtained from the process of the invention is sent to a catalytic cracking unit, preferably a fluidised-bed catalytic cracking (FCC) unit. From this catalytic cracking unit there are recovered, in particular, an LCO (light cycle oil) fraction and an HCO (heavy cycle oil) fraction which can be sent at least in part (either one or the other or a mixture of the two) to the process according to the present invention at the input of at least one of the reaction zones of the process (HDM and/or HDR and/or HCK and preferably HDR and/or HCK), preferably at the input of the first reaction zone in operation for said section(s). In general, the HCO is sent to the HDM section and the LCO is sent to the HDR and/or HCK section. The amount of LCO and/or HCO then sent to the process according to the invention is included in the total amount described hereinbefore.

The fluidised-bed catalytic cracking reactor can operate in an upflow and in a downflow. It is also conceivable to carry out the catalytic cracking in a moving-bed reactor, although that is not a preferred embodiment. Particularly preferred catalytic cracking catalysts are those containing at least one zeolite usually mixed with an appropriate matrix such as, for example, alumina, silica, silica-alumina.

Steam Cracking

According to another variant of the process, at least a part of the atmospheric residue and/or the vacuum distillate and/or the vacuum residue obtained from the process of the invention is sent to a steam cracking unit. From this steam cracking unit there is recovered, in particular, a C5+ fraction which has a high content of aromatic, olefinic and/or diolefinic products and can be sent (either immediately or after fractionation by distillation or after extraction of the aromatics or after another treatment) at least in part to the process according to the present invention at the input of at least one of the reaction zones of the process (HDM and/or HDR and/or HCK and preferably HDR and/or HCK), preferably at the input of the first reaction zone in operation for said section(s). The amount of the fraction C5+ sent to the process according to the invention is included in the total amount described hereinbefore.

Preferred Embodiments

The process can operate in accordance with one of the following alternatives:

- the hydrorefining and hydrocracking sections comprise switchable reaction zones;
- all the sections comprise switchable reaction zones and by-passable reaction zones;
- the hydrodemetallation section comprises the switchable reaction zones and also at least one by-passable reaction zone; the HDR and HCK sections consist of by-passable reaction zones and at least one of said zones in the HDR section and in the HCK section is not by-passed;
- the hydrodemetallation section comprises only the (preferably 2) switchable reaction zones and the hydrorefining and hydrocracking sections comprise a single non-by-passed reaction zone.

In one of the embodiments of the process of the invention, the hydrorefining and hydrocracking sections also comprise switchable reaction zones; in particular, all the sections consist of switchable reaction zones. Thus, each section (the HDM, HDR and HCK section) comprises at least two switchable reaction zones, each containing at least one catalyst and arranged in series in order to be used in a cyclic manner consisting in successively repeating steps b) and c) defined hereinafter:

a) a step in which the reaction zones of a section are used all together for a duration at most equal to the time for deactivating and/or clogging one of them,
b) a step during which at least one of the reaction zones is by-passed and the catalyst which it contains is regenerated and/or replaced by fresh or regenerated catalyst,
c) a step during which the reaction zones of a section are used all together, the reaction zone(s), the catalyst of which has been regenerated and/or replaced over the course of the preceding step, being reconnected either in their initial positions (what is known as the "simple" mode) or in another position among the switchable reaction zones (what is known as the "exchanged" mode), and said step being conducted over a duration at most equal to the time for deactivating and/or clogging one of the reaction zones.

The process according to the invention can be carried out in accordance with what is known as a "simple" mode or what is known as an "exchanged" mode as defined hereinbefore; this last provision allows the operating factor of the unit and the run duration of the process to be improved.

In another embodiment of the process of the invention, all the sections consist of switchable reaction zones and by-passable reaction zones. Thus, each section (the HDM, HDR and HCK section) comprises at least two switchable reaction zones, each containing at least one catalyst and arranged in series in order to be used in a cyclic manner consisting in successively repeating steps b) and c) defined hereinafter, and one or more reaction zones which can be by-passed separately or non-separately in accordance with steps d) and e) defined hereinafter. The mode of operation of each section of the hydrocracking process of the invention comprises the following steps:

a) a step in which the reaction zones of a section are used all together for a duration at most equal to the time for deactivating and/or clogging one of them,
b) a step during which at least one of the reaction zones is by-passed and the catalyst which it contains is regenerated and/or replaced by fresh or regenerated catalyst,
c) a step during which the reaction zones of a section are used all together, the reaction zone(s), the catalyst of which has been regenerated and/or replaced over the course of the preceding step, being reconnected either in their initial positions (what is known as the "simple" mode) or in another position among the switchable reaction zones (what is known as the "exchanged" mode), and said step being conducted over a duration at most equal to the time for deactivating and/or clogging one of the reaction zones,
d) a step in which at least one of the reaction zones of the hydrodemetallation section and/or or the deep hydrorefining section and/or the hydrocracking section can be by-passed over the course of the run when the catalyst is deactivated and/or clogged and the catalyst which it contains is regenerated and/or replaced by fresh or regenerated catalyst,
e) a step during which the reaction zones, the catalyst of which has been regenerated and/or replaced over the course of the preceding step, are reconnected in their initial positions.

The process according to the invention can be carried out in accordance with what is known as a "simple" mode or what is known as an "exchanged" mode as defined hereinbefore; this last provision allows the operating factor of the unit and the run duration of the process to be improved.

The carrying-out of the process according to the invention comprises another variant, which is a preferred embodiment of the present invention, in which the HDM section consists of switchable reaction zones and the HDR and HCK sections consist of by-passable reaction zones. The carrying-out of the process comprises the following steps:

a) a step in which the reaction zones are used all together for a duration at most equal to the time for deactivating and/or clogging the most upstream reaction zone in relation to the global direction of movement of the treated feedstock,
b) a step during which the feedstock directly penetrates the reaction zone situated immediately after that which was the most upstream over the course of the preceding step and during which the reaction zone which was the most upstream over the course of the preceding step is by-passed and the catalyst which it contains is regenerated and/or replaced by fresh or regenerated catalyst,
c) a step during which the reaction zones are used all together, the reaction zone, the catalyst of which has been regenerated and/or replaced over the course of the preceding step, being reconnected so as to be downstream of all of the switchable reaction zones of its section and said step being conducted over a duration at most equal to the time for deactivating and/or clogging the reaction zone which is, over the course of this step, the most upstream in relation to the global direction of movement of the treated feedstock,
d) a step in which at least one of the reaction zones of the hydrodemetallation section and/or or the hydrorefining section and/or the hydrocracking section can be by-passed over the course of the run when the catalyst is deactivated and/or clogged and the catalyst which it contains is regenerated and/or replaced by fresh or regenerated catalyst,
e) a step during which the reaction zones, the catalyst of which has been regenerated and/or replaced over the course of the preceding step, are reconnected in their initial positions.

In a variant of the process of the invention, the HDR and HCK sections consist of by-passable reaction zones and the HDM section also comprises at least one by-passable reaction zone.

In the preferred embodiment of the process, the most upstream reaction zone in the global direction of movement of the feedstock is gradually loaded with metals, coke, sediments and a broad range of other impurities and is disconnected as soon as is desired but most often when the catalyst which it contains is almost saturated with metals and a broad range of impurities.

In a preferred embodiment, a particular conditioning section is used allowing the switchable reaction zones to be switched on-stream, i.e. without stopping the operation of the unit. The section comprises firstly a system which operates at moderate pressure (from 1 MPa to 5 MPa but preferably from 1.5 MPa to 2.5 MPa) and allows the following operations to be carried out on the disconnected reaction zone: washing, stripping, cooling, before unloading of the spent catalyst; then heating and sulphidation after loading of the fresh or regenerated catalyst. Subsequently, another pressurisation/depressurisation and gate valves system comprising appropriate technology effectively allows these reaction zones to be switched without stopping the unit, i.e. without affecting the operating factor, since all of the operations of washing, stripping, unloading of the spent catalyst, reloading of the fresh or regenerated catalyst, heating, sulphidation, are carried out on the disconnected reaction zone.

In an advantageous embodiment, the unit will comprise a conditioning section (not shown in the FIGURE) provided with appropriate movement, heating, cooling and separation means operating independently of the reaction section, allowing the operations for preparing the fresh or regenerated catalyst contained in the switchable reaction zone and/or the by-passed reaction zone to be carried out by means of conduits and valves just before being connected, while the unit is on-stream, namely: preheating of the zone in the process of being switched or by-passed, sulphidation of the catalyst which it contains, setting of the required pressure and temperature conditions. When the operation of switching or by-passing this reaction zone has been carried out by means of the set of appropriate valves, this same section will also allow the operations to be carried out for conditioning the spent catalyst contained in the reaction zone just after disconnection of the reaction zone, namely: washing and stripping of the spent catalyst under the required conditions, then cooling before proceeding to the operations for unloading of this spent catalyst, then of replacement by fresh or regenerated catalyst.

BRIEF DESCRIPTION OF DRAWING

FIG. 1

FIG. 1 is a brief illustration of the invention. In this FIGURE, the process according to the invention is carried out in the 3 sections (the HDM section, the HDR section and the HCK section), each section being itself composed of 5 reaction zones. As stated hereinbefore, these reaction zones can be composed of one or more different reactors or of one or more different catalytic beds situated in a single reactor.

The HDM section (M1 to M5) is composed of 2 switchable reaction zones (M1, M2) which are followed by 3 by-passable reaction zones (M3, M4, M5). In order to simplify the description of the FIGURE, the 3 sections are organised in an identical manner.

In FIG. 1, the valves allowing the various reaction zones to be insulated, by-passed or switched, as well as the onsets of the internal or external recycles, are also not shown so as not to overload the FIGURE. In the same way, the section for conditioning of the catalysts, which is provided with appropriate movement, heating, cooling and separation means operating independently of the reaction zones, allowing the operations for preparing the fresh or regenerated catalyst contained in the by-passed reaction zone to be carried out by means of conduits and valves just before being connected, while the unit is on-stream, has also not been shown. The lines allowing petroleum cuts to be recycled or external petroleum cuts to be injected upstream of one or more reaction zones have also not been shown.

In a starting configuration, the feedstock arrives in the HDM section through the conduit 2, where it is mixed with hydrogen which originates from the conduit 1. This mixture enters the reaction zone M1 and the effluent leaves this reaction zone through the conduit 3, allowing it to be conveyed to the reaction zone M2. From the reaction zone M2, the hydrocarbons and the hydrogen pass into the reaction zone M3 through the conduit 4, then into the reaction zone M4 through the conduit 5 and into the reaction zone M5 through the conduit 6. The mixture then leaves this reaction zone M5 through the conduit 7. At least a part (and generally all) of this effluent is sent to the HDR section through the conduit 8, any residual effluent being evacuated through the conduit 9.

Still in this configuration, the reaction mixture enters the HDR section through the conduit 22, feeding the reaction zone R1. The effluent from this reaction zone R1 passes into the reaction zone R2 through the conduit 23. From the reaction zone R2, the mixture of hydrocarbons and hydrogen passes into the reaction zone R3 through the conduit 24, then into the reaction zone R4 through the conduit 25 and into the reaction zone R5 through the conduit 26. The mixture then leaves this reaction zone R5 through the conduit 27. At least a part (and generally all) of this effluent is sent to the HCK section through the conduit 28, any residual effluent being evacuated through the conduit 29.

Subsequently, the reaction mixture enters the HCK section through the conduit 42 which feeds the reaction zone K1. The effluent from this reaction zone K1 passes into the reaction zone K2 through the conduit 43. From the reaction zone K2, the mixture of hydrocarbons and hydrogen passes into the reaction zone K3 through the conduit 44, then into the reaction zone K4 through the conduit 45 and into the reaction zone K5 through the conduit 46. The mixture then leaves this reaction zone K5 through the conduit 47. At least a part of this effluent is sent to the distillation section through the conduit 48, any residual effluent being evacuated through the conduit 49.

In the embodiment of FIG. 1, using 2 switchable reaction zones (M1, M2 or R1, R2 or K1, K2) and 3 by-passable reaction zones (M3 to M5 or R3 to R5 or K3 to K5) in each section (the HDM, HDR and HCK section), the two switchable reaction zones, each containing at least one catalyst, are arranged in series in order to be used in a cyclic manner consisting in successively repeating steps b) and c) defined hereinafter, and one or more reaction zones which can be by-passed separately or non-separately in accordance with steps d) and e) defined hereinafter. For the HDM section, the mode of operation of the hydrocracking process of the invention presented in FIG. 1 comprises the following steps:

a) a step in which the reaction zones M1 to M5 of the HDM section are used all together for a duration at most equal to the time for deactivating and/or clogging one of them, for which the flow of the fluids has been described hereinbefore as being the starting configuration, b) a step during which the first switchable reaction zone M1 is by-passed and the catalyst which it contains is regenerated and/or replaced by fresh or regenerated catalyst, whereas the reaction mixture passes into the switchable reaction zone M2 through the conduit 11, leaves through the conduit 4 to the reaction zone M3, passes into the reaction zone M4 via the conduit 5, into the reaction zone M5 through the conduit 6 before leaving the HDM section through the conduit 7, c) a step during which the reaction zones of the HDM section are used all together, the reaction zone M1, the catalyst of which has been regenerated and/or replaced over the course of the preceding step, being reconnected behind the reaction zone M2 via the conduit 12 (what is known as the "exchanged" mode), the effluent from this zone being sent to the reaction zone M3 through the conduit 13, said step being conducted over a duration at most equal to the time for deactivating and/or clogging one of the reaction zones, d) a step in which at least one of the by-passable reaction zones M3, M4 and M5 of the HDM section is by-passed through the conduits 14, 15 and 16 respectively when the catalyst is deactivated and/or clogged and the catalyst which it contains is regenerated and/or replaced by fresh or regenerated catalyst; for example, the zone M3 is by-passed; as soon as the effluent obtained from the last switchable reaction zone in operation passes directly into the zone M4 through the conduit 14 and the catalyst of the zone M3 is regenerated and/or replaced by fresh or regenerated catalyst, e) a step during which the reaction zones, the catalyst of which has been regenerated and/or replaced over the course of the preceding step, are reconnected in their initial positions; for example, once the catalyst from the zone M3 has been regenerated, the zone M3 is reconnected, and the effluent obtained from the last switchable zone in operation passes into the zone M3 via the conduit 4, the conduit 14 being closed.

For the HDR and HCK sections, the mode of operation of the switchable reaction zones and the by-passable reaction zones is identical. The description is therefore completely analogous and will therefore not be repeated. The relevant and referenced parts from FIG. 1 will merely be listed:

HDR section: conduits for the switching: 31, 32, 33; conduits for the by-pass: 34, 35, 36.

HCK section: conduits for the switching: 51, 52, 53; conduits for the by-pass: 54, 55, 56.

The operation of the switchable or by-passable reaction zones will be readily understood from the description of FIG. 1. FIG. 1 has shown by way of example a particular configuration of these zones in the sections. All the combinations are possible. As was previously stated, the preferred mode comprises (or consists of) 2 switchable reaction zones for the HDM section, 1 or 2 by-passable reaction zones for the HDR section and 1 or 2 by-passable reaction zones for the HCK section.

EXAMPLES

Example 1 (Not in Accordance with the Invention)

This example illustrates hydrocracking on a standard feedstock, containing less than 200 ppm by weight of asphaltenes and less than 10 ppm of metals. The characteristics are set out in Table 1.

As this feedstock does not contain any metals and contains only a few asphaltenes, it is therefore not necessary to provide any HDM catalyst in the sections preceding the actual hydrocracking section (Table 1).

The hydrocracking used in the HDR section (a single reaction zone) is a catalyst, the catalytic formulation of which is of the NiMo type deposited on an alumina support, for example the catalyst HRK558 from AXENS. In the HCK section (a single reaction zone), use is made of a catalyst, the catalytic function of which is of the NiMo type deposited on a support containing zeolite Y, for example the catalyst HYC642 from AXENS.

Using conventional operating conditions (Table 1), with a start-of-run (SOR) temperature of 385° C., an organic nitrogen content at the input of the HCK section which is lower than 10 ppm by weight is achieved. Over the course of the run, the catalyst from the HDR section is deactivated and it is necessary to increase the temperature of the reaction zones in order to compensate for this loss of activity due to coking. In our example, this increase is on average approximately 1° C. per month. It is possible to continue to increase the reaction temperature up to the maximum limit of the unit, which is 420° C. This temperature therefore imposes the end of the run and is called the end-of-run (EOR) temperature. With this standard feedstock, the run duration is 36 months.

| Feedstock | |
|---|---|
| density d15/4 | 0.94 g/cc |
| organic nitrogen | 1,200 ppm |
| asphaltenes | <50 ppm |
| metals | 0 ppm |
| Catalysts upstream of the HCK section | |
| fraction of HDM catalyst | 0% |
| fraction of HDR catalyst | 100% |
| HDR operating conditions | |
| total pressure | 150 bar |
| $HVR_{HDR}$ | 1.1 $h^{-1}$ |
| SOR temperature | 385° C. |
| EOR temperature | 420° C. |
| HDR target | |
| nitrogen content at HDR output | <10 ppm |
| HCK operating conditions | |
| total pressure | 150 bar |
| $HVR_{HCK}$ | 1.3 $h^{-1}$ |
| SOR temperature | 390° C. |
| Performance levels | |
| crude conversion 370° C.+ | 75.3% |
| gas oil yield | 49.6% |
| cetane gas oil | 60 |
| VI oil | 128 |
| Run duration | |
| run duration | 36 months |

Example 2 (Not in Accordance with the Invention)

This example illustrates hydrocracking on a difficult feedstock, containing more than 200 ppm by weight of asphaltenes and more than 10 ppm of metals. The characteristics are set out in Table 2.

As in the preceding example, this feedstock is treated in a process not containing any HDM catalyst in the sections preceding the actual hydrocracking section (Table 2).

The catalysts used and the sections are the same as previously.

Using conventional operating conditions (Table 2), with a start-of-run (SOR) temperature of 385° C., an organic nitrogen content at the input of the HCK section which is lower than 10 ppm by weight is achieved. It will be noted that, as the feedstock is more difficult, the hourly volume rate of the HDM+HDR section necessary in order to achieve an organic nitrogen content of 10 ppm by weight has had to be reduced and is now equal to $0.7^{-1}$. Over the course of the run, the catalyst is deactivated and it is necessary to increase the temperature of the reaction zones in order to compensate for the loss of activity. The metals are deposited on the HDR catalyst, introducing a very rapid second deactivation mechanism and necessitating a more rapid rise in temperature than in Example 1. By increasing the reaction temperature up to the end-of-run (EOR) temperature, the run duration is only 11 months.

| Feedstock | |
|---|---|
| density d15/4 | 0.95 g/cc |
| organic nitrogen | 1,800 ppm |
| asphaltenes | 2,000 ppm |
| metals | 15 ppm |
| Catalysts upstream of the HCK section | |
| fraction of HDM catalyst | 0% |
| fraction of HDR catalyst | 100% |
| HDM + HDR operating conditions | |
| total pressure | 150 bar |
| $HVR_{HDM+HDR}$ | 0.7 $h^{-1}$ |
| SOR temperature | 385° C. |
| EOR temperature | 420° C. |
| HDM + HDR target | |
| nitrogen content at HDR output | <10 ppm |
| HCK operating conditions | |
| total pressure | 150 bar |
| $HVR_{HCK}$ | 1.3 $h^{-1}$ |
| SOR temperature | 390° C. |
| Performance levels | |
| crude conversion 370° C.+ | 64.3% |
| gas oil yield | 45.6% |
| cetane gas oil | 53 |
| VI oil | 126 |
| Run duration | |
| run duration | 11 months |

Example 3 (Not in Accordance with the Invention)

This example illustrates the effect of the HDM catalyst on the run duration during hydrocracking on a difficult feedstock, containing more than 200 ppm by weight of asphaltenes and more than 10 ppm of metals (feedstock from Example 2). The characteristics are set out in Table 3.

The feedstock from the preceding example is in this case treated in a process using HDM catalyst in the HDM section (a single reaction zone) which is a typical NiMo catalyst deposited on a macroporous alumina support, for example the catalyst HMC868 from AXENS. The catalysts used in the HDR and HCK sections are the same as previously, as are said sections.

Using conventional operating conditions (Table 3), with a start-of-run (SOR) temperature of 385° C., an organic nitrogen content at the input of the HCK section which is lower than 10 ppm by weight is achieved. Over the course of the run, the catalyst is deactivated and it is necessary to increase the temperature of the reaction zones in order to compensate for this loss of activity of the catalyst. Initially, the HDR catalyst is protected by an HDM catalyst and the metals are deposited thereon. Conversely, after about 7 months of operation, this HDM catalyst no longer retains all the metals of this feedstock, which are now deposited on the HDR catalyst, thus introducing a very rapid second deactivation mechanism. By increasing the reaction temperature up to the end-of-run (EOR) temperature, the run duration is only 18 months.

| Feedstock | |
|---|---|
| density d15/4 | 0.95 g/cc |
| organic nitrogen | 1,800 ppm |
| asphaltenes | 2,000 ppm |
| metals | 15 ppm |
| Catalysts upstream of the HCK section | |
| fraction of HDM catalyst | 8% |
| fraction of HDR catalyst | 92% |
| HDM + HDR operating conditions | |
| total pressure | 150 bar |
| $HVR_{HDM+HDR}$ | 0.7 $h^{-1}$ |

-continued

| | |
|---|---|
| SOR temperature | 385° C. |
| EOR temperature | 420° C. |
| HDM + HDR target | |
| nitrogen content at HDR output | <10 ppm |
| HCK operating conditions | |
| total pressure | 150 bar |
| $HVR_{HCK}$ | 1.3 $h^{-1}$ |
| SOR temperature | 390° C. |
| Performance levels | |
| crude conversion 370° C.+ | 64.3% |
| gas oil yield | 45.6% |
| cetane gas oil | 53 |
| VI oil | 126 |
| Run duration | |
| run duration | 18 months |

Example 4 (In Accordance with the Invention)

This example illustrates the effect of the use of switchable reaction zones in the HDM section on the run duration during hydrocracking on a difficult feedstock, containing more than 200 ppm by weight of asphaltenes and more than 10 ppm of metals. The characteristics are set out in Table 4.

The feedstock from the preceding example is treated in a process using HDM catalyst in the HDM section which consists of 2 switchable reaction zones. These 2 zones switch their position every 3 to 4 months. After this period, the reaction zone which is in the first position is by-passed and the catalyst which it contains is replaced by fresh catalyst. After conditioning of the fresh catalyst, this reaction zone is reconnected in the second position, behind the HDM reaction zone which has not been by-passed (what is known as the "exchanged mode").

In the HDM section, use is made of a typical NiMo catalyst deposited on a macroporous alumina support, for example the catalyst HMC868 from AXENS. The catalysts used in the HDR and HCK sections are the same as previously.

Using conventional operating conditions (Table 4), with a start-of-run (SOR) temperature of 385° C., an organic nitrogen content at the input of the HCK section which is lower than 10 ppm by weight is achieved. Over the course of the run, the catalyst is deactivated and it is necessary to increase the temperature of the reaction zones in order to compensate for the loss of activity.

Initially, the HDR catalyst is protected by an HDM catalyst and the metals are deposited thereon. After a little more than 3 months of operation, the first reaction zone containing half of the amount of HDM catalyst no longer retains all the metals of the feedstock, which are now deposited on the HDM catalyst of the second reaction zone. The first reaction zone is therefore by-passed and the catalyst which it contains is replaced by fresh catalyst, before reconnecting this reaction zone in the second position behind the HDM reaction zone which has not been by-passed. In this way, the HDR catalyst continues to be protected during the catalyst replacement operation. Throughout the duration of the run, the most deactivated HDM catalyst (that from the HDM reaction zone which is in the first position) will therefore be replaced by fresh HDM catalyst every 3 to 4 months, while at the same time switching the position of the two HDM reaction zones. The switching period, defined as the duration after which an HDM reaction zone returns to its original position, is in our example 7 months.

In order to compensate for the reduction in the activity of the HDR catalyst due to coking, the reaction temperature of this reaction zone is increased up to the end-of-run (EOR) temperature. In this configuration, the run duration is again 36 months, while at the same time treating a difficult feedstock, containing more than 200 ppm by weight of asphaltenes and more the 10 ppm of metals.

| | |
|---|---|
| Feedstock | |
| density d15/4 | 0.95 g/cc |
| organic nitrogen | 1,800 ppm |
| asphaltenes | 2,000 ppm |
| metals | 15 ppm |
| Catalysts upstream of the HCK section | |
| fraction of HDM catalyst | 8% |
| fraction of HDR catalyst | 92% |
| HDM + HDR operating conditions | |
| total pressure | 150 bar |
| $HVR_{HDM+HDR}$ | 0.7 $h^{-1}$ |
| SOR temperature | 385° C. |
| EOR temperature | 420° C. |
| switching period | 7 months |
| HDM + HDR target | |
| nitrogen content at HDR output | <10 ppm |
| HCK operating conditions | |
| total pressure | 150 bar |
| $HVR_{HCK}$ | 1.3 $h^{-1}$ |
| SOR temperature | 390° C. |
| Performance levels | |
| crude conversion 370° C.+ | 64.3% |
| gas oil yield | 45.6% |
| cetane gas oil | 53 |
| VI oil | 126 |
| Run duration | |
| run duration | 36 months |

These results show that, in the absence of HDM catalyst, the run duration is only 11 months; in the presence of HDM catalyst, it is increased to 18 months, but that the implementation of the same amount of HDM catalyst in 2 switchable reaction zones allows the run duration to be doubled in an unexpected manner, at a very limited outlay. This economical and simple process allows the treatment of feedstocks having relatively high asphaltenes contents (2,000 ppm by weight in the example).

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application Ser. No. 08/07.270, filed Dec. 18, 2008 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for hydrocracking of hydrocarbon feedstocks containing 200 ppm to 2% by weight of asphaltenes, and/or more than 10 ppm by weight of metals, wherein said feedstock is subjected to a hydrodemetallation treatment between 300° C. and 450° C., under a total pressure of from 50 to 300 bar, with a hydrogen/hydrocarbons ratio of between 200 $Nm^3/m^3$ and 2,000 $Nm^3/m^3$, said treatment being carried out in at least 2 switchable reactors each containing at least one hydrodemetallation catalyst and optionally containing a hydrodenitrification catalyst, said reactors being arranged in series in order to be used in a cyclic manner comprising successively repeating steps b) and c) defined hereinafter:

a) a step in which the reactors are used all together for a duration at most equal to the time for deactivating and/or clogging one of them, b) a step during which at least one of the reactors is by-passed and the catalyst which it contains is regenerated and/or replaced by fresh or regenerated catalyst, c) a step during which the reactors are used all together, the switchable reactor(s), the catalyst of which has been regenerated and/or replaced over the course of the preceding step, being reconnected either in the initial position or in another position among the switchable reactors, and said step being conducted over a duration at most equal to the time for deactivating and/or clogging one of the switchable reactors, then at least a part of the effluent, which is at least partly demetallated and optionally partly denitrified, is hydrorefined in a hydrorefining section containing at least one hydrotreatment catalyst in order to lower the organic nitrogen content to below 20 ppm by weight, the hydrorefining being carried out at a temperature between 300° C. and 450° C., under a total pressure of from 50 to 300 bar, with a hydrogen/hydrocarbons ratio of between 200 $Nm^3/m^3$ and 2,000 $Nm^3/m^3$, then at least a part of the effluent, which is at least partly denitrified, is hydrocracked in a hydrocracking section containing at least one fixed-bed hydrocracking catalyst, between 300° C. and 450° C., under a total pressure of from 50 to 300 bar, and a hydrogen/hydrocarbons ratio of between 300 $Nm^3/m^3$ and 3,000 $Nm^3/m^3$, then at least a part of the hydrocracked effluent is distilled by atmospheric distillation in order to obtain at least one gas oil cut, a naphtha cut and an atmospheric residue, said residue optionally being at least partly distilled under vacuum in order to obtain at least one vacuum distillate and a vacuum residue.

2. A process according to claim 1, wherein the switchable reactor, the catalyst of which has been regenerated and/or replaced, is reconnected so as to be in the last position, relative to the flow of the feedstock, in the series of the switchable reactors.

3. A process according to claim 1, wherein the process operates in accordance with one of the following alternatives:

the hydrorefining and hydrocracking sections comprise switchable reactors;

all the sections comprise switchable reactors and by-passable reactors or catalytic beds;

the hydrodemetallation section comprises the switchable reactors and also at least one by-passable reactor or catalytic bed; the hydrorefining (HDR) and hydrocracking (HCK) sections consist of by-passable reactors or catalytic beds;

the hydrodemetallation section comprises only the switchable reactors and the hydrorefining and hydrocracking sections comprise a single non-by-passable reactor or catalytic bed.

4. A process according to claim 1, wherein the hydrodemetallation section and/or the hydrorefining section operates with a sequence of 2 or more hydrodemetallation and/or respectively hydrorefining catalysts, and wherein the average diameter of said catalysts decreases in the direction of flow of the feedstock.

5. A process according to claim 1, wherein the hydrodemetallation section and/or the hydrorefining section operates with a sequence of 2 or more hydrodemetallation catalysts and/or hydrorefining catalysts, and wherein the activity of said catalysts increases in the direction of flow of the feedstock.

6. A process according to claim 1, wherein each of the switchable reactors of the hydrodemetallation section contains hydrodemetallation catalyst and hydrodenitrification catalyst.

7. A process according to claim 1, wherein, before being hydrocracked, the effluent is subjected to a separation of the gases.

8. A process according to claim 1, wherein the effluent entering on the hydrocracking catalyst has an organic nitrogen content of lower than 10 ppm by weight and an asphaltenes content of lower than 200 ppm by weight.

9. A process according to claim 1, wherein at least a part of the atmospheric residue and/or of the gas oil cut and/or of the vacuum distillate is recycled to the hydrodemetallation section and/or to the hydrocracking section and/or to the hydrorefining section.

10. A process according to claim 1, wherein at least a part of the vacuum residue is recycled to the hydrocracking section and/or to the hydrorefining section.

11. A process according to claim 1, wherein the recycled amount of atmospheric residue and/or gas oil and/or vacuum distillate represents by weight, relative to the fresh feedstock entering the section, about 1 to 60%.

12. A process according to claim 1, wherein the feedstock is demetallated, then hydrorefined and hydrocracked in a reactor or catalytic bed K and the effluent is at least partly distilled in an atmospheric distillation zone in which the atmospheric residue obtained is at least partly hydrocracked in a reactor or catalytic bed K', which is different from the reactor or catalytic bed K, containing at least one hydrocracking catalyst, and the effluent obtained is at least partly distilled in the distillation zone.

13. A process according to claim 1, wherein the feedstock comprises a vacuum distillate and/or a deasphalted oil.

14. A process according to claim 1, wherein the feedstock comprises a vacuum distillate (VGO) and/or a deasphalted oil (DAO) mixed with effluents obtained from conversion units.

15. A process according to claim 1, wherein there is injected, at the input of at least one of the catalytic beds of the process, reactor or catalytic bed in operation, at least one gas oil having an initial boiling point of between 140° C. and 260° C. and having a final boiling point of between 300° C. and 440° C. or a heavy cycle oil HCO having an initial boiling point of between 300° C. and 450° C. and having a final boiling point of between 400° C. and 600° C.

16. A process according to claim 11, wherein said recycled amount constitutes 10 to 20%.

17. A process according to claim 15, wherein the said at least one gas oil is injected into the input of the first reactor or catalytic bed in operation.

18. A process for hydrocracking of hydrocarbon feedstocks containing 200 ppm to 2% by weight of asphaltenes, and/or more than 10 ppm by weight of metals, wherein said feedstock is subjected to a hydrodemetallation treatment between 300° C. and 450° C., under a total pressure of from 50 to 300 bar, with a hydrogen/hydrocarbons ratio of between 200 $Nm^3/m^3$ and 2,000 $Nm^3/m^3$, said treatment being carried out in at least 2 switchable reactors each containing at least one hydrodemetallation catalyst and optionally containing a hydrodenitrification catalyst, said reactors being arranged in series in order to be used in a cyclic manner comprising successively repeating steps b) and c) defined hereinafter:

a) a step in which the reactors are used all together for a duration at most equal to the time for deactivating and/or clogging one of them, b) a step during which at least one of the reactors is by-passed and the catalyst which it contains is regenerated and/or replaced by fresh or regenerated catalyst, c) a step during which the reactors are used all together, the switchable reactor(s), the catalyst of which has been regenerated and/or replaced over the course of the preceding step, being reconnected either in the initial position or in another position among the switchable reactors, and said step being conducted over a duration at most equal to the time for deactivating and/or clogging one of the switchable reactors, then at least a part of the effluent, which is at least partly demetallated and optionally partly denitrified, is hydrorefined in a hydrorefining section containing at least one hydrotreatment catalyst in order to lower the organic nitrogen content to below 20 ppm by weight, the hydrorefining being carried out at a temperature between 300° C. and 450° C., under a total pressure of from 50 to 300 bar, with a hydrogen/hydrocarbons ratio of between 200 $Nm^3/m^3$ and 2,000 $Nm^3/m^3$, then at least a part of the effluent, which is at least partly denitrified, is hydrocracked in a hydrocracking section containing at least one fixed-bed hydrocracking catalyst, between 300° C. and 450° C., under a total pressure of from 50 to 300 bar, and a hydrogen/hydrocarbons ratio of between 300 $Nm^3/m^3$ and 3,000 $Nm^3/m^3$, then at least a part of the hydrocracked effluent is distilled by atmospheric distillation in order to obtain at least one gas oil cut, a naphtha cut and an atmospheric residue, said residue optionally being at least partly distilled under vacuum in order to obtain at least one vacuum distillate and a vacuum residue, wherein the hydrodemetallation and hydrorefining treatments operate with a catalytic system comprising at least two catalysts, one for hydrodemetallation and the other for hydrorefining, said catalysts comprise at least one support comprising a porous refractory oxide, at least one group VIB metal, and at least two group VIII metals, of which one is the majority promoter called VIII-1 and the other or others are called co-promoter VIII-i wherein i is between 2 and 5 and, in these catalysts, the group VIII elements are present in the proportions defined by the atomic ratio [VIII-1/(VIII-1+. . . +VIII-i)] of between 0.5 and 0.85 and at least one hydrodemetallation catalyst and at least one hydrorefining catalyst have an identical atomic ratio;

the hydrodemetallation catalyst(s) has/have a group VIB metal or metals content of between 2 and 9% by weight of trioxide of the group VIB metal or metals relative to the total mass of the catalyst, and the sum of the group VIII metals contents is between 0.3 and 2% by weight of the oxide of the group VIII metals relative to the total mass of the catalyst, the hydrorefining catalyst(s) has/have a group VIB metal or metals content which is strictly higher than 9 and lower than 17% by weight of trioxide of the group VIB metal or metals relative to the total mass of the catalyst, and the sum of the group VIII metals contents is strictly higher than 2 and lower than 5% by weight of the oxide of the group VIII metals relative to the total mass of the catalyst.

19. A process according to claim 18, wherein said catalytic system is contained in the first switchable input reactor(s) of the hydrodemetallation (HDM) section and in the first input reactor(s) or the first input catalytic bed(s) of the hydrorefining (HDR) section.

20. A process according to claim 19, wherein the hydrorefining (HDR) section generally comprises a by-passable reactor or reactors or a by-passable catalytic bed or beds which are downstream of the reactor(s) or of the catalytic bed(s) containing said catalytic system, and which contain a catalyst or catalysts having metals contents higher than those of the catalytic system.

21. A process for hydrocracking of hydrocarbon feedstocks containing 200 ppm to 2% by weight of asphaltenes, and/or more than 10 ppm by weight of metals, wherein said feedstock is subjected to a hydrodemetallation treatment between 300° C. and 450° C., under a total pressure of from 50 to 300 bar, with a hydrogen/hydrocarbons ratio of between 200 $Nm^3/m^3$ and 2,000 $Nm^3/m^3$, said treatment being carried out in at least 2 switchable reactors each containing at least one hydrodemetallation catalyst and optionally containing a hydrodenitrification catalyst, said reactors being arranged in series in order to be used in a cyclic manner comprising successively repeating steps b) and c) defined hereinafter:

a) a step in which the reactors are used all together for a duration at most equal to the time for deactivating and/or clogging one of them, b) a step during which at least one of the reactors is by-passed and the catalyst which it contains is regenerated and/or replaced by fresh or regenerated catalyst, c) a step during which the reactors are used all together, the switchable reactor(s), the catalyst of which has been regenerated and/or replaced over the course of the preceding step, being reconnected either in the initial position or in another position among the switchable reactors, and said step being conducted over a duration at most equal to the time for deactivating and/or clogging one of the switchable reactors, then at least a part of the effluent, which is at least partly demetallated and optionally partly denitrified, is hydrorefined in a hydrorefining section containing at least one hydrotreatment catalyst in order to lower the organic nitrogen content to below 20 ppm by weight, the hydrorefining being carried out at a temperature between 300° C. and 450° C., under a total pressure of from 50 to 300 bar, with a hydrogen/hydrocarbons ratio of between 200 $Nm^3/m^3$ and 2,000 $Nm^3/m^3$, then at least a part of the effluent, which is at least partly denitrified, is hydrocracked in a hydrocracking section containing at least one fixed-bed hydrocracking catalyst, between 300° C. and 450° C., under a total pressure of from 50 to 300 bar, and a hydrogen/hydrocarbons ratio of between 300 $Nm^3/m^3$ and 3,000 $Nm^3/m^3$, then at least a part of the hydrocracked effluent is distilled by atmospheric distillation in order to obtain at least one gas oil cut, a naphtha cut and an atmospheric residue, said residue optionally being at least partly distilled under vacuum in order to obtain at least one vacuum distillate and a vacuum residue, wherein the fixed-bed hydrocracking catalyst is a supported catalyst.

22. A process according to claim 1, wherein at least one of the switchable reactors contains a hydrodenitrofication catalyst.

23. A process according to claim 1, conducted substantially continuously in a series of connected reactors.

* * * * *